US005833233A

United States Patent [19]

Strug

[11] Patent Number: 5,833,233

[45] Date of Patent: Nov. 10, 1998

[54] BASKETBALL HAND TRAINING DEVICE

[75] Inventor: Stanley Strug, 5775 Sir Walter Scott, Suite 106, Cote St, Luc, Quebec, Canada, H4W 1S4

[73] Assignees: Stanley Strug; Panex International Corp., both of Ontario, Canada

[21] Appl. No.: 601,282

[22] Filed: Feb. 16, 1996

[51] Int. Cl.[6] ..... A63B 69/00

[52] U.S. Cl. ..... 273/1.5 A

[58] Field of Search ..... 273/1.5 AR, 55 R; 2/160, 161.1

[56] References Cited

U.S. PATENT DOCUMENTS

| | | | |
|---|---|---|---|
| 2,845,628 | 8/1958 | Dell | 273/1.5 A X |
| 3,496,573 | 2/1970 | Kuchar et al. | 273/44 X |
| 3,501,773 | 3/1970 | Stansberry et al. | 273/1.5 A X |
| 3,606,614 | 9/1971 | Dimitroff | 273/55 X |
| 3,640,532 | 2/1972 | Bauer . | |
| 3,707,730 | 1/1973 | Slider | 273/1.5 X |
| 4,738,447 | 4/1988 | Brown . | |
| 5,236,190 | 8/1993 | Moss . | |
| 5,500,956 | 3/1996 | Schulkin et al. | 273/1.5 X |

OTHER PUBLICATIONS

KBA Basketball Coaching and Training Aids, 1989 School Mail Order Catalog, p. 8, KBA Shooting Glove, Dec. 1988.

*Primary Examiner*—Paul E. Shapiro
*Attorney, Agent, or Firm*—McFadden, Fincham

[57] ABSTRACT

A training device is provided which spaces the palm of a basketball player's hand from the basketball such that only the fingertips contact the surface of the ball. The device is releasably engageable with the hand of the user and has a generally trapezoidal cross-section. The interior surface of the device is contoured to generally correspond to the arcuate shape of the basketball. The result of the using the structure is the training of the player to more accurately shoot the ball.

14 Claims, 2 Drawing Sheets

BASKETBALL HAND TRAINING DEVICE

FIELD OF THE INVENTION

The present invention is directed to a basketball hand training device and more particularly, the present invention is directed to a lightweight device for training the shooting hand of a basketball player.

BACKGROUND OF THE INVENTION

In basketball, the skills required to be an effective player are innumerable. One of the key skills that must be mastered is skillful throwing or shooting the basketball. Inexperienced players often have an incorrect hand position and as a result, such players often miss shots or lose control of the ball when they are passed the ball from another player. One of the key areas that needs to be mastered is the position of the finger tips on the ball such that the palm is arched and spaced from the arcuate surface of the ball. In the manner, the user's finger tips maximize the amount of surface area of contact on the ball thus affording a higher degree of balance which, in turn, is related to a more accurate shot.

A host of devices have been previously proposed in the art to circumvent the hand positioning problem. Typical of these references is U.S. Pat. No. 4,738,447, issued Apr. 19, 1988, to Brown. In this reference, a training glove is disclosed which has a glove body having cut out finger portions as well as an arch plate to maintain the player's palm and ball in a spaced relationship. An auxiliary support member is also provided with this arrangement. The device does not provide a body which has got a substantial width dimension and accordingly, it would appear that it does not space the ball from the palm of the user to any real degree such that the palm would be arched and the fingers spread apart for a maximum contact of the finger tips on the ball. In addition, this arrangement by virtue of the fact that it incorporates a glove, would appear to be somewhat of a hinderance with respect to maximum mobility of the fingers and the remainder of the hand.

Bauer, in U.S. Pat. No. 3,640,532, issued Feb. 8, 1972, provides a hand device for training basketball players. The device, in this instance, is essentially a flexible tube having a strap longitudinally therethrough as well as straps for interdigital positioning. This arrangement, since the same is a flexible member, would appear to have limited effectiveness in the training procedure desired. The tube would appear to function to space the ball from the palm of the user, but this would also appear to be only in a local area since the apparatus is worn about the hand, generally high and close to the top of the palm. In this manner, a substantial amount of the palm is not covered and would therefore appear to be available for contact with the ball. Further still, the flexible tube does not appear to have the capacity to force the fingers and palm away from the surface of the ball such that only the tips are in contact therewith.

U.S. Pat. No. 5,236,190, issued Aug. 17, 1993, to Moss provides a basketball grip training device which attaches to the hand of a user by a releasable strap. The arrangement provides an audible arm system to indicate to the user when proper finger positioning is achieved. The apparatus appears to only provide a spaced relationship with the ball in a very local area towards the center portion of the palm and accordingly, would not facilitate proper arching of the palm or finger tip contact only.

In view of what has been previously proposed in the basketball grip training art, it would appear that there is a need for a significantly improved arrangement which more effectively positions the hand of a user about the ball to consistently result in an accurate shot.

SUMMARY OF THE INVENTION

One object of the present invention is to provide an improved grip training device for basketball players to assist in training of the proper muscle groups and arching of the palm. A further object of the present invention is to provide a training device for training a basketball player, comprising: a palm-covering body for substantially spanning the area of a user's palm, the body having a contoured first face for positioning against a user's palm and an arcuate second face spaced from the first face for contact with a basketball; and means for releasably fastening the body to a user's hand.

It has been found advantageous to provide a palm covering body which substantially covers the entire area of the palm and further which has a width dimension. These features have been found effective to adequately space the ball from the palm of the user while at the same time arching the palm of the user thus forcing the finger tips into contact with the ball surface as opposed to full contact with the fingers and thumb.

To complement the above features, conveniently the body may take on a generally trapezoidal shape with an arcuate portion directed to be in contact with the palm of the user and a further arcuate portion for contact with the ball surface. In this manner, the arcuate surface may comprise a slightly concave portion and further, it may be provided with a gripping surface.

In terms of the gripping surface, any suitable material may be employed such as adhesive strips, a textured surface composed of pebbles, diagonal lines, diamonds or any other suitable frictional surface.

A further attendant feature of the present invention is realized by fabricating the article out of lightweight plastic. This has been found effective since it does not add any significant strain to the hand of the user and is not susceptible to premature wear. To augment this feature, it has been found effective to provide a simple releasable strap system for positioning about the top portion of the hand. This keeps the mobility of the hand to an absolute maximum while positively retaining the article on the palm of the user.

A further object of the present invention is to provide a device for training the hand of a basketball user, the device comprising: a body, the body having a substantially trapezoidal cross-section, a first face and a second face in spaced relation, the first face having a contour adapted for contact with a user's palm, the second face having an arcuate shape adapted for contact with a basketball; and strap means associated with the body for positioning the body about the hand of user.

Suitable plastics may include polyethylene, polystyrene, styrofoam, high impact styrene, polypropylene, among a host of other suitable lightweight compounds.

In an alternate embodiment, the hollow body may include apertures therethrough in order to prevent perspiration build-up between the palm of the user and the face contacting the palm.

Having thus generally described the invention, reference will now be made to the accompanying drawings illustrating preferred embodiments.

DETAILED DESCRIPTION OF THE PREFERRED EMBODIMENTS

Figure 1:
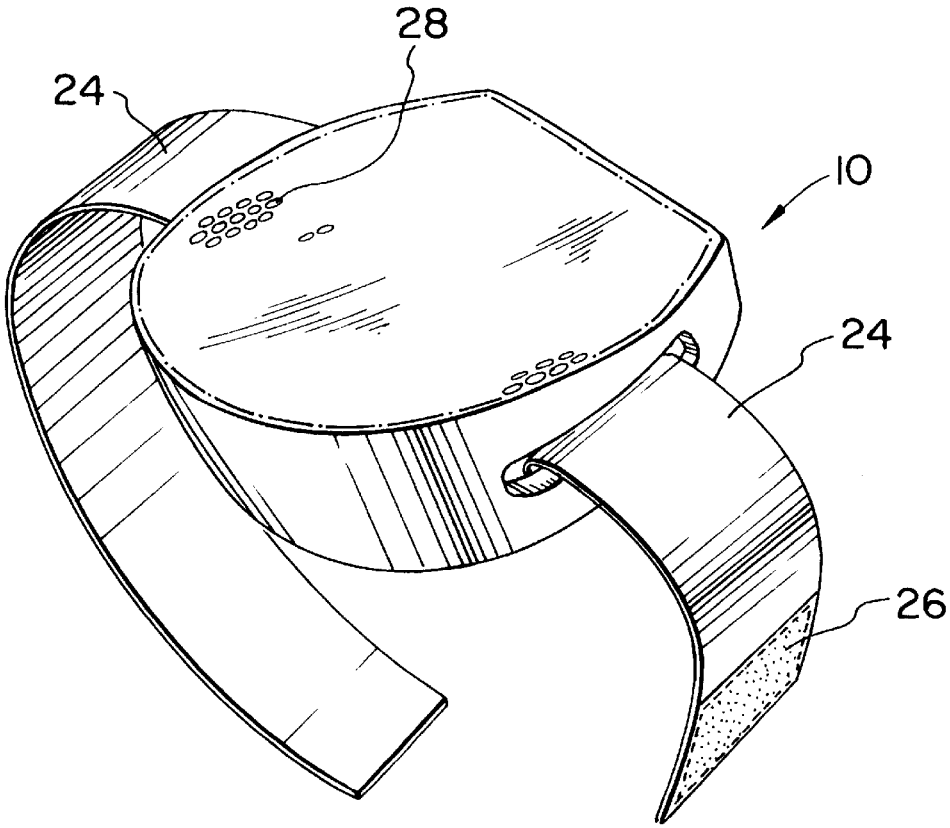
FIG. 1 is a perspective view of the training device according to one embodiment of the present invention.
Figure 2:
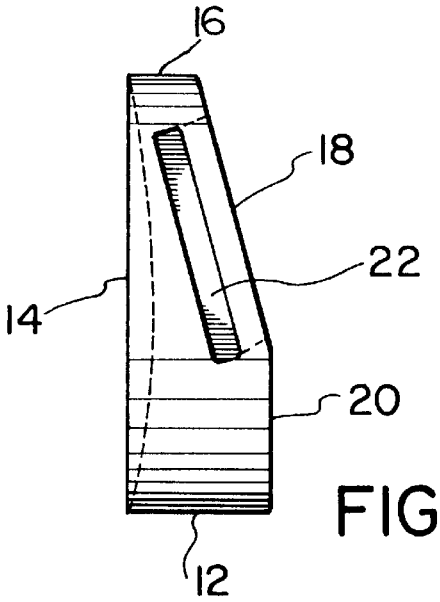
FIG. 2 is a cross-sectional view of the article of FIG. 1.
Figure 3:
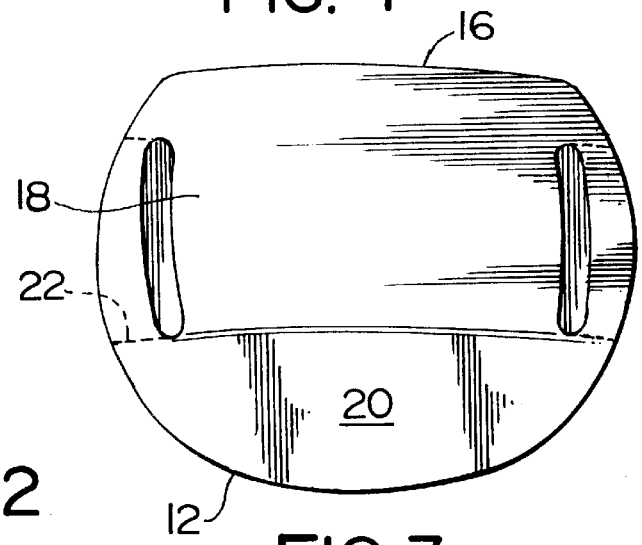
FIG. 3 is a rear elevational view of FIG. 2.
Figure 4:
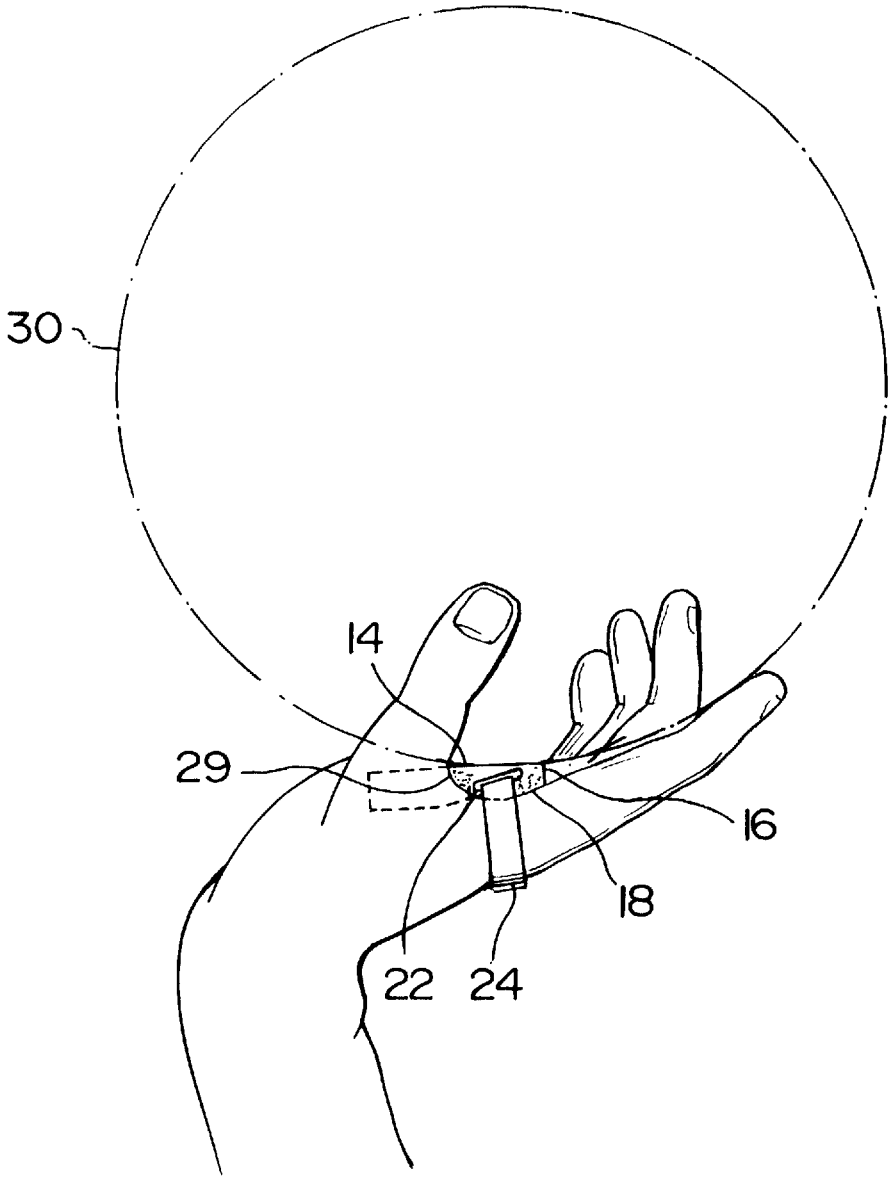
FIG. 4 is a side view of the article in the use position as positioned about the hand of a user.

Referring now to the drawings and particularly, FIG. 1, shown as the training device in a first embodiment, globally denoted by numeral 10. The one-piece body of the device generally subscribes to a trapezoidal form as illustrated in FIG. 2 in cross-section. In this manner, the body has an arcuate base wall 12 and a first face 14 having a generally perpendicular outline relative to base 12 and concave interior shown in dashed line. A top segment 16 is generally perpendicular to face 14. Segment 16 blends with a downwardly inclined face 18, the downwardly inclined face 18 being inclined relative to front face 14. The downwardly inclined face 18 blends with a generally perpendicular wall 20. The latter terminating at base 12 and being in a spaced parallel relationship with face 14. As is illustrated in the Figures, face 14 is spaced from face 18 and wall 20 such that the device has a width dimension. The body further includes a pair of registering slots extending through the body and denoted by numeral 22, shown more clearly in FIG. 3. A releasable strap 24 is provided for positioning the device 10 about the hand of a user as illustrated in FIG. 4. The strap may include any suitable fastening arrangement, e.g., buckles, magnetic joins, quick release means or simply Velcro as indicated by numeral 26 on the strap 24.

In order to facilitate enhanced grip, the face 14 of the article 10 may include a friction surface in the form of a pebbled textured surface as illustrated in FIG. 1 and denoted by numeral 28 or any other suitable form of material having a high coefficient of friction, e.g. adhesive, sandpaper, projections, etc.

Turning to FIG. 4 in greater detail, the disposition of the apparatus 10 in the palm 29 of the user and the position of a basketball, the latter being globally denoted by numeral 30, is illustrated. As shown, the device 10 spaces the ball 30 from the palm of the user substantially to the point that only the finger tips contact the surface of the ball 30. In order to contribute to this finger positioning, the device 10 further forces an arcuate shape in the palm of the user such that this finger arrangement is facilitated by the trapezoidal shape of the body and more particularly the disposition of wall 20 and face 18 in the angular disposition that they provide. Advantageously, the ball 30 is designed such that it spreads the fingers of the user while face 18, due to the inclined disposition, facilitates the arching of the palm and thus assists in the positioning of the fingers adjacent the ball surface.

In an alternate embodiment, the body may include apertures therethrough in order to prevent excessive heat build-up between the palm 29 of the user and the device.

As a particularly convenient feature, the device may be made of a lightweight plastic and this end may be hollow in order to be less burdensome to the user.

Suitable materials may include polypropylene, polyethylene, high impact polystyrene, polystyrene or any other suitable lightweight material.

Although embodiments of the invention have been described above, it is not limited thereto and it will be apparent to those skilled in the art that numerous modifications form part of the present invention insofar as they do not depart from the spirit, nature and scope of the claimed and described invention.

I claim:

1. A device for training a basketball player to handle a basketball only with his fingertips, comprising:

a palm-covering body for substantially spanning the area of a user's palm, said body having a first face contoured to conform generally to the arch of the palm of a user holding a basketball properly on his fingertips, for positioning against a user's palm to form the palm of the user's hand into the proper arch, and an arcuate second face spaced from said first face, a distance sufficient to space a basketball in contact therewith from a user's palm such that a user can contact the basketball only with his fingertips; and means for releasably fastening said body to a user's hand.

2. The device as set forth in claim 1, wherein said body comprises a rigid body.

3. The device as set forth in claim 2, wherein said body has a trapezoidal cross-section.

4. The device as set forth in claim 3, wherein said body includes openings for receiving a strap means.

5. The device as set forth in claim 4, wherein said openings comprise slots.

6. The device as set forth in claim 5, wherein said means for releasably fastening said body to a user's hand comprises straps received in said slots.

7. The device as set forth in claim 6, wherein said body comprises a polymeric substance.

8. The device as set forth in claim 7, wherein said second face include means for retention of basketball.

9. A device for training the hand of a basketball player, said device comprising:

a body, said body having a substantially trapezoidal cross-section, a first face and a second face in spaced relation, said first face having a contour conforming generally to the arch of the palm of a user holding a basketball properly on his fingertips, adapted for contact with a user's palm to form the palm of the user's hand into the proper arch, said second face having an arcuate shape adapted for contact with a basketball and spaced from said first face a distance sufficient to space a basketball in contact therewith from a user's palm such that a user can contact the basketball only with his fingertips; and strap means associated with said body for positioning said body about the hand of user.

10. A device as set forth in claim 9, wherein said body comprises a rigid plastic.

11. A device as set forth in claim 10, wherein said body comprises a hollow body.

12. A device as set forth in claim 9, wherein said second face includes texture means for frictional engagement with said ball.

13. A device as set forth in claim 10, wherein said body comprises a hollow body.

14. A device as set forth in claim 10, wherein said arcuate shape comprises a concave indentation in said second face of said body.

* * * * *